US010712034B2

(12) United States Patent
Hill et al.

(10) Patent No.: US 10,712,034 B2
(45) Date of Patent: Jul. 14, 2020

(54) VARIABLE FREQUENCY DRIVES SYSTEMS AND METHODS

(71) Applicant: Johnson Controls Technology Company, Auburn Hills, MI (US)

(72) Inventors: Ryan E. Hill, Cockeysville, MD (US); Harold J. Dubensky, Lancaster, PA (US); Sandeep K. Chodapaneedi, Red Lion, PA (US); Lindsey C. Walker, York, PA (US); Nivedita Nath, Pune (IN); Keith L. Glatfelter, York, PA (US); Bhushan D. Vichare, Sangli (IN); Gnanesh Suvvada, Vizianagaram (IN); Siddappa R. Bidari, Pune (IN); Justin M. Fantom, York, PA (US); Deepak S. Kollabettu, Post Bejai Mangalore (IN); William J. Skinner, Jr., Millersville, PA (US); David A. Shearer, Hanover, PA (US); David P. Gillmen, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 100 days.

(21) Appl. No.: 15/957,597

(22) Filed: Apr. 19, 2018

(65) Prior Publication Data

US 2019/0293312 A1 Sep. 26, 2019

Related U.S. Application Data

(60) Provisional application No. 62/645,636, filed on Mar. 20, 2018.

(51) Int. Cl.
*F24F 11/32* (2018.01)
*F24F 11/88* (2018.01)
(Continued)

(52) U.S. Cl.
CPC ..... *F24F 11/32* (2018.01); *F24F 11/74* (2018.01); *F24F 11/88* (2018.01); *F24F 2140/00* (2018.01)

(58) Field of Classification Search
CPC .. F24F 11/32; F24F 11/74; F24F 11/88; F24F 2140/00
See application file for complete search history.

(56) References Cited

U.S. PATENT DOCUMENTS 5,878,191 A * 3/1999 Miyashita ..... H01L 21/67115 392/416
8,096,139 B2 1/2012 Taras et al.
(Continued)

OTHER PUBLICATIONS

Seggewiss, George P., Schachter, Nathan P., Obermeyer, Gregory P., Bankay, Gary; "Considerations for Implementing MV Drives in a Cement Plant"; Rockwell Automation Milwaukee, WI; Cement Industry Technical Conference Record, 2008 IEEE.

*Primary Examiner* — Henry T Crenshaw
(74) *Attorney, Agent, or Firm* — Fletcher Yoder, P.C.

(57) ABSTRACT

A heating, ventilation, and air conditioning system includes an air moving device configured to move air through the HVAC system, a first variable frequency drive (VFD) configured to drive the air moving device, and a second VFD configured to drive the air moving device, wherein the first VFD and the second VFD are configured receive control instructions and to selectively operate based on the control instructions.

21 Claims, 6 Drawing Sheets

(51) Int. Cl.
*F24F 11/74* (2018.01)
*F24F 140/00* (2018.01)

(56) References Cited

U.S. PATENT DOCUMENTS

| | | | | |
|---|---|---|---|---|
| 8,193,660 | B2 | 6/2012 | Rockenfeller et al. | |
| 8,278,778 | B2 | 10/2012 | Rockenfeller et al. | |
| 8,299,646 | B2 | 10/2012 | Rockenfeller et al. | |
| 8,779,698 | B2 | 7/2014 | Havard et al. | |
| 10,296,016 | B1 * | 5/2019 | Payne | G05D 7/0617 |
| 2008/0082183 | A1 * | 4/2008 | Judge | G05B 15/02 700/33 |
| 2013/0087302 | A1 * | 4/2013 | McKie | F28F 27/006 165/8 |
| 2014/0097779 | A1 * | 4/2014 | Hopkins | H02P 5/52 318/460 |
| 2014/0260965 | A1 * | 9/2014 | Finkam | B01D 53/30 95/12 |
| 2016/0102873 | A1 * | 4/2016 | Harris | F24F 7/08 165/217 |
| 2016/0328945 | A1 * | 11/2016 | Greisser | F24F 11/30 |
| 2017/0229864 | A1 * | 8/2017 | Cheng | H01H 47/00 |
| 2017/0292733 | A1 * | 10/2017 | Uemura | F24F 11/74 |
| 2017/0314799 | A1 | 11/2017 | LeRoy et al. | |
| 2019/0199086 | A1 * | 6/2019 | Li | H02H 7/1225 |
| 2019/0249754 | A1 * | 8/2019 | Oehring | E21B 37/00 |

* cited by examiner

VARIABLE FREQUENCY DRIVES SYSTEMS AND METHODS

CROSS REFERENCE TO RELATED APPLICATION

This application is a Non-Provisional application claiming priority to U.S. Provisional Application No. 62/645,636, entitled "VARIABLE FREQUENCY DRIVES SYSTEMS AND METHODS," filed Mar. 20, 2018, which is hereby incorporated by reference in its entirety for all purposes.

BACKGROUND

The present disclosure relates generally to heating, ventilation, and air conditioning systems. A wide range of applications exist for heating, ventilating, and air conditioning (HVAC) systems. For example, residential, light commercial, commercial, and industrial systems are used to control temperatures and air quality in residences and buildings. Such systems often are dedicated to either heating or cooling, although systems are common that perform both of these functions. Very generally, these systems operate by implementing a thermal cycle in which fluids are heated and cooled to provide the desired temperature in a controlled space, typically the inside of a residence or building. Similar systems are used for vehicle heating and cooling, and as well as for general refrigeration. Many HVAC systems may utilize fans, or blowers, in operation. For example, fans may be used for expelling exhaust air, moving air through a heat exchanger, and drawing in return air. The HVAC system may also include a variable frequency drive (VFD) which may receive power from a power source and control a speed of the fan by providing power at a suitable level to the fans.

SUMMARY

The present disclosure relates to a heating, ventilation, and air conditioning (HVAC) system having an air moving device configured to move air through the HVAC system, a first variable frequency drive (VFD) configured to drive the air moving device, and a second VFD configured to drive the air moving device, wherein the first VFD and the second VFD are configured receive control instructions and to selectively operate based on the control instructions.

The present disclosure also relates to a heating, ventilation, and air conditioning (HVAC) system including a first air moving device configured to move air through the HVAC system, a second air moving device configured to move air through the HVAC system, a first variable frequency drive (VFD) configured to variably supply power to the first air moving device and the second air moving device based on control instructions, and a second VFD configured to variably supply power to the first air moving device and the second air moving device based on the control instructions.

The present disclosure further relates to a heating, ventilation, and air conditioning (HVAC) system having a fan configured to drive air through the HVAC system, a first variable frequency drive (VFD) configured to provide power to the fan, a second VFD configured to provide power to the fan, and a controller configured to control the first VFD and the second VFD to alternatingly provide power to the fan.

DRAWINGS

DETAILED DESCRIPTION

The present disclosure is directed to heating, ventilation, and air conditioning (HVAC) systems and units, which may include fans powered by redundant variable frequency drives (VFDs), or more than one VFD, of a control system. Particularly, the fans may be powered by one of the VFDs at a time. For example, if the VFD that is providing power to the fan discontinues operation, the other VFD may then activate to provide power to the fan. In this manner, the HVAC system may continue to provide conditioned air to a building even if one of the VFDs has become unavailable. Indeed, the HVAC system may avoid down-time through the redundancy of the VFDs. Operation may also switch between the VFDs in other instances. For example, the HVAC system may utilize one of the VFDs prior to a power-down and power-up sequence of the HVAC system and may utilize the other VFD subsequent to the power-down and power-up sequence. Further, in some instances, the HVAC system may switch operation between the VFDs to help equalize respective total run-times of the VFDs or to activate a particular VFD if it has been inactive for an extended period of time.

Figure 1:
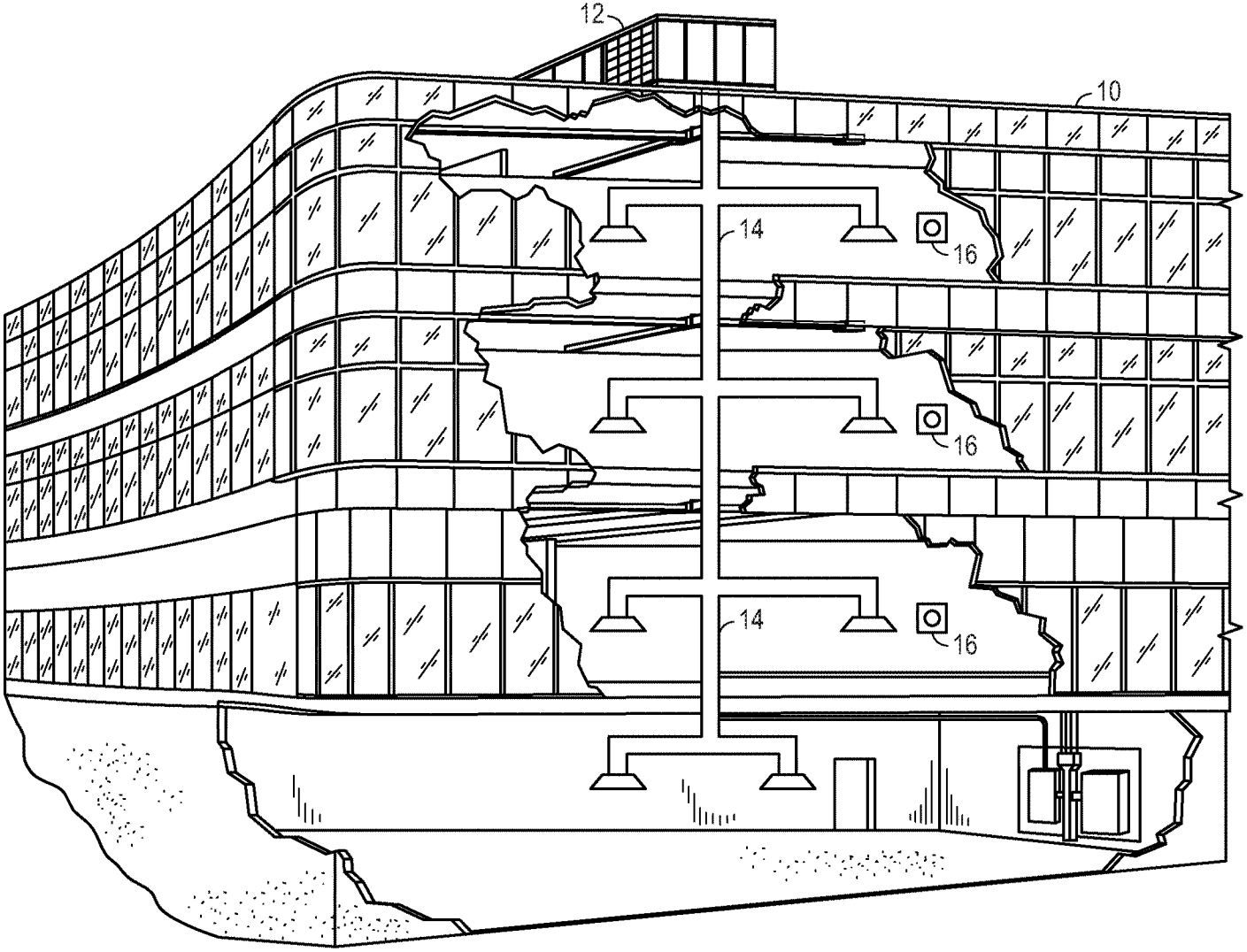
FIG. 1 is a perspective view of a heating, ventilation, and air conditioning (HVAC) system for building environmental management that may employ one or more HVAC units, in accordance with an embodiment of the present disclosure.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, such as a thermostat, a zone sensor, and/or a return air sensor, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
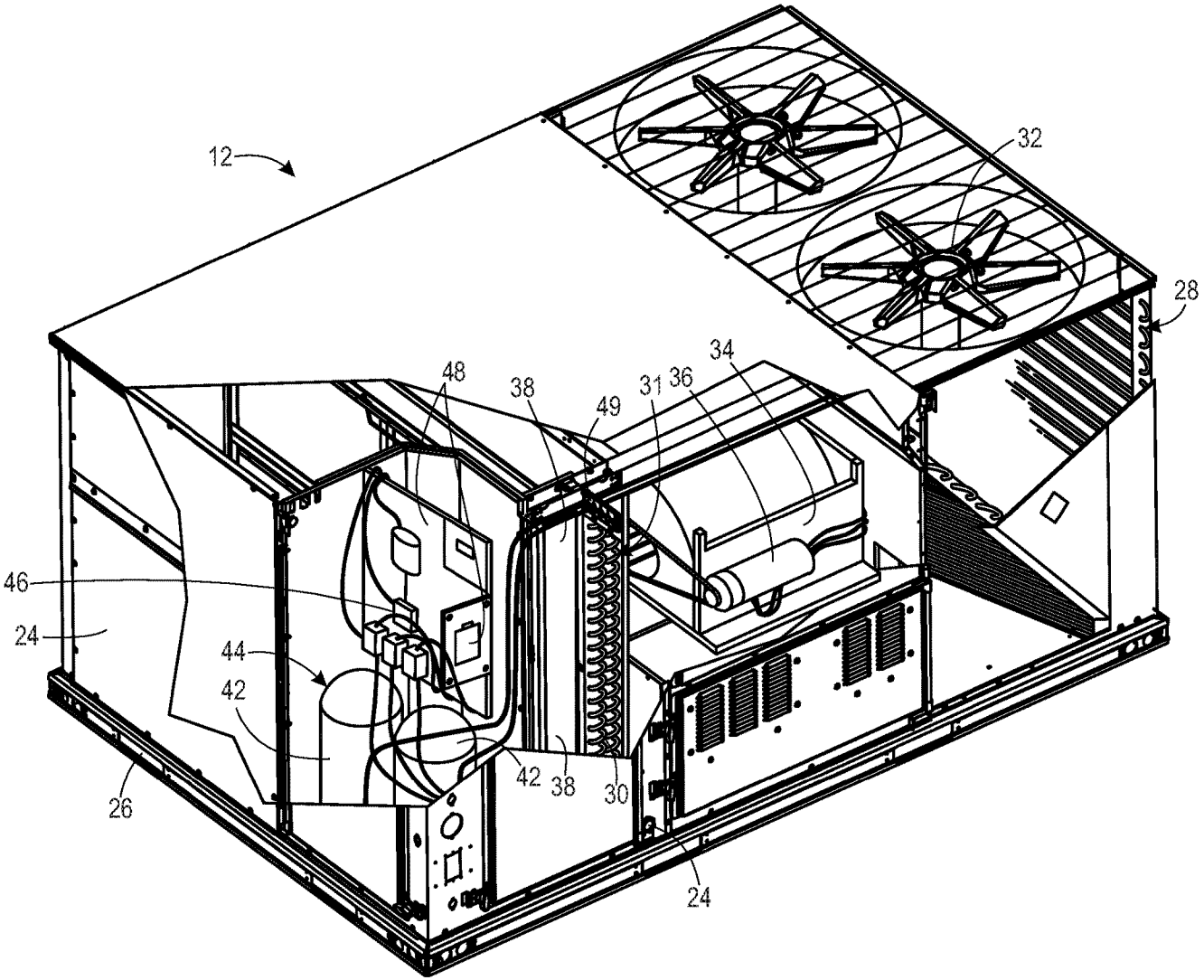
FIG. 2 is a perspective view of an HVAC unit of the HVAC system of FIG. 1, in accordance with an embodiment of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation and/or insulated with a double wall construction having insulation within the double wall. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
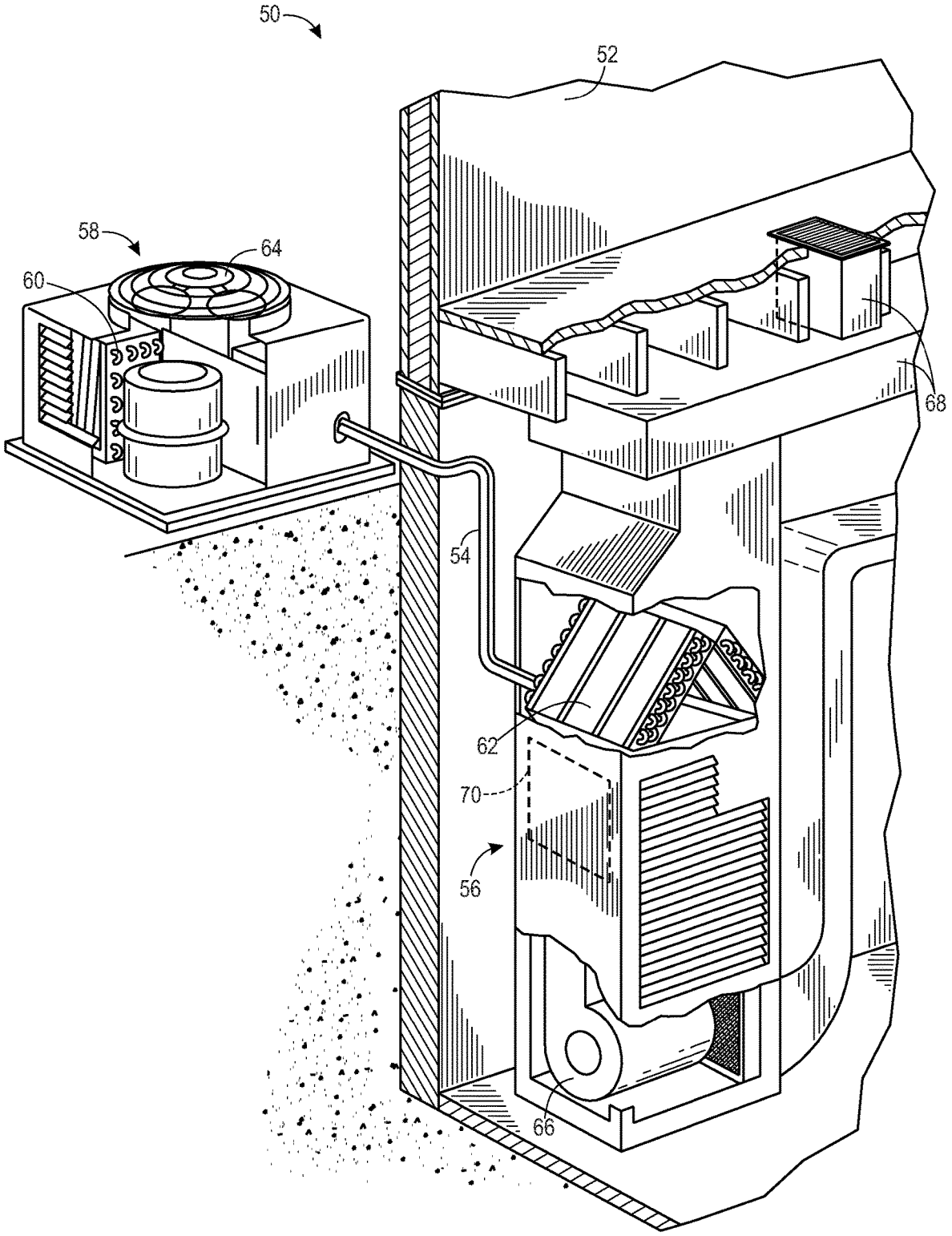
FIG. 3 is a perspective view of a residential split heating and cooling system, in accordance with an embodiment of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
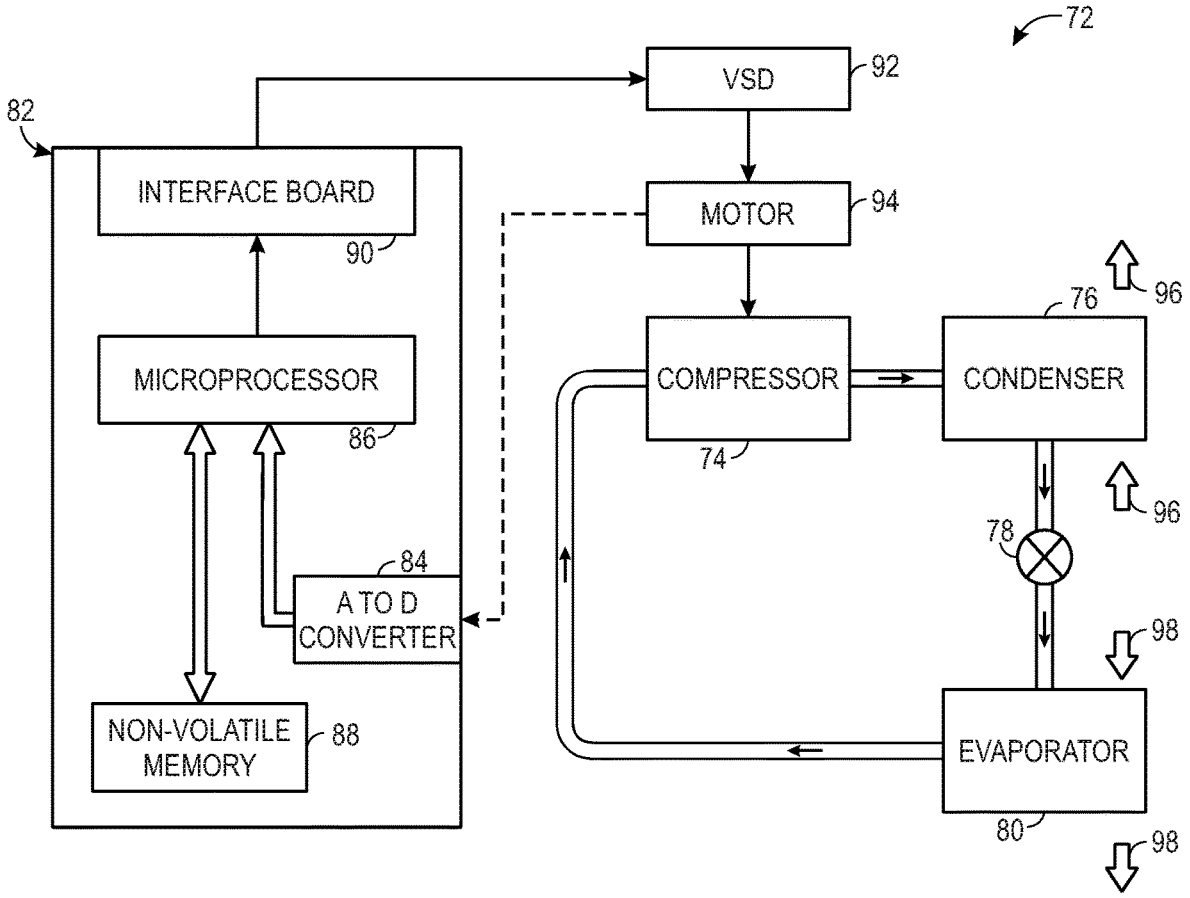
FIG. 4 is a schematic view of a vapor compression system that may be used in an HVAC system, in accordance with an embodiment of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed below, an HVAC system, such as the HVAC unit 12, the heating and cooling system 50, and/or the vapor compression system 72 may utilize fans and/or blowers, such as the fans 32, the blower assembly 34, the fan 64, and/or the blower 66. The HVAC system may also utilize a plurality of variable frequency drives (VFDs) to power the fans. For example, the HVAC system may utilize a first VFD to power the fans during a first time period and may switch to a second VFD to power the fans during a second time period. In some instances, operation may switch from the first VFD to the second VFD after a certain time period has elapsed, upon power-down and/or power-up of the HVAC system, and/or if the VFD in operation unexpectedly discontinues operation. The use of redundant VFDs, or the plurality of VFDs, may provide for the HVAC system, and more specifically, the fans of the HVAC system, to continue operation if one of the VFDs becomes unavailable or undergoes a maintenance or replacement process.

Figure 5:
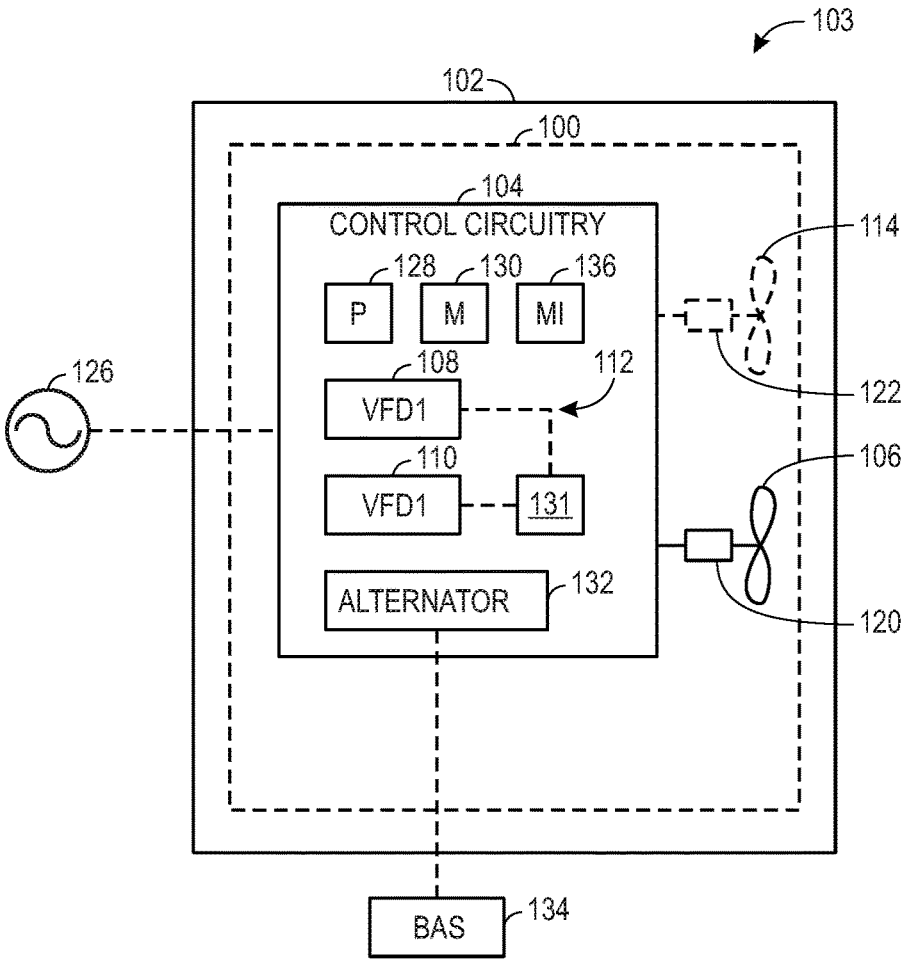
FIG. 5 is a schematic view of a fan section of an HVAC system, in accordance with an embodiment of the present disclosure.

To illustrate, FIG. 5 is a schematic diagram of fan section 100 of an air handler 102 of an HVAC system 103. In some embodiments, the air handler 102 may be a rooftop unit. Further, in certain embodiments, the HVAC system 103 may include the HVAC unit 12, the heating and cooling system 50, the vapor compression system 72, or any of the components in such systems. The fan section 100 includes control circuitry 104 configured to supply power to and control a speed of a fan 106. More specifically, the control circuitry 104 may control the fan 106 through a first variable frequency drive (VFD) 108 or a second VFD 110, which may be generally be referred to herein as VFDs 112, or a VFD 112. Indeed, as described herein, the control circuitry 104 may switch between providing power to the fan 106 through the first VFD 108 and providing power to the fan 106 through the second VFD 110.

In certain embodiments, control circuitry 104 may also provide power to and control a speed of a second fan 114 through either of the VFDs 112. Indeed, it is to be understood that the control circuitry 104 may provide power to and control a speed of any number of fans through the VFDs 112. For example, the control circuitry 104 may control one, two, three, four, five, or any suitable number of fans. In certain embodiments, the fan 106 and/or the second fan 114 may be an air supply fan, an exhaust fan, a condenser fan, an intake fan, or any other fan, blower, or other air moving device within the HVAC system 103, or any combination of types of air moving devices. Further, as discussed herein, the control circuitry 104 may control the fan 106 and the second fan 114 through either of the VFDs 112. However, it should be understood that the VFDs 112 control the fan 106 and the second fan 114 through a first motor 120 and a second motor 122, respectively, which may in turn actuate or drive the fans 106, 114 as a result of the power supplied through the VFDs 112. Further, while discussion herein of the VFDs 112 may refer to controlling the fan 106, it should be understood that the discussion of the VFDs 112 herein may also refer to the VFDs 112 providing individualized control to multiple fans (e.g., one or multiple VFDs 112 simultaneously controlling multiple fans), which may include the fan 106, the second fan 114, and/or other fans/blowers. Further still, while discussion of the VFDs 112 may focus on switching operation from the first VFD 108 to the second VFD 110, it should be understood that operation may similarly switch from the second VFD 110 to the first VFD 108 and may switch between the VFDs 112 any suitable amount of times.

The VFDs 112 may be any suitable type of VFD that is configured to supply varied frequency and voltage to the fan 106 via the motor 120 in order to control a torque and speed of the fan 106. For example, each of the VFDs 112 may receive power from a power source 126, which may be an alternating current (AC) power source, a generator, an electrical grid, solar panels, or any other suitable power source. Further, each of the VFDs 112 may include a rectifier/converter, which may rectify incoming AC voltage to direct current (DC) voltage. Each of the VFDs 112 may also include a DC bus and inverters. The DC bus is configured to receive the DC voltage from the rectifier/converter and supply the DC voltage to the inverters. The inverters may receive the DC voltage from the DC bus and convert the DC voltage to a suitable frequency and voltage to supply to the motor 120 of the fan 106.

Further, the control circuitry 104 may employ a processor 128, which may represent one or more processors, such as an application-specific processor. The control circuitry 104 may also include a memory device 130 for storing instructions executable by the processor 128 to perform the methods and control actions described herein for the air handler 102. For example, as discussed below, the processor 128 and the memory 130 may be utilized to switch operation between the first VFD 108 and the second VFD 110. The processor 128 may include one or more processing devices, and the memory 130 may include one or more tangible, non-transitory, machine-readable media. By way of example, such machine-readable media can include RAM, ROM, EPROM, EEPROM, CD-ROM, or other optical disk storage, magnetic disk storage or other magnetic storage devices, or any other medium which can be used to carry or store desired program code in the form of machine-executable instructions or data structures and which can be accessed by the processor 128 or by any general purpose or special purpose computer or other machine with a processor.

As discussed herein, the control circuitry 104 may switch between utilizing the first VFD 108 or the second VFD 110 to power the fan 106 via the motor 120. To this end, there are multiple scenarios that may trigger the control circuitry 104 to switch operation between the first VFD 108 and the second VFD 110. For example, it may be beneficial to operate the first VFD 108 and the second VFD 110 for substantially equal amounts of time. Therefore, in certain embodiments, the operation of the VFDs 112 may be associated with respective run times, which may be stored as time-stamps within the memory 130. That is, a time-stamp may be recorded when a respective VFD 112 initiates operation and when the respective VFD 112 discontinues operation. For example, if the first VFD 108 is currently in operation and a total run-time associated with the first VFD 108 reaches a predetermined amount greater than a total run-time associated with the second VFD 110, the control circuitry 104 may switch operation from the first VFD 108 to the second VFD 110. In some embodiments, the predetermined amount may be approximately one day, one week, one month, six months, one year, or any other suitable amount of time.

Further, in certain embodiments, the control circuitry 104 may switch operation between the first VFD 108 and the second VFD 110 if one of the VFDs 112 is inactive, or not in operation, for an extended period of time, or a certain time threshold. In some embodiments, the time threshold may be approximately six months, nine months, one year, or any other suitable time. In certain embodiments, one of the VFDs 112 may be activated upon reaching the time threshold for being inactive and may be deactivated once it has been powered up, which in some embodiments, may take approximately ten to twenty seconds. Indeed, it may be beneficial to activate one of the VFDs 112 if it has been inactive for an extended period of time. For example, certain components of the control circuitry 104, such as capacitors, may experience decreased longevity if left inactive for an extended period of time.

Further still, in certain embodiments, the control circuitry 104 may switch operation between the first VFD 108 and the second VFD 110 upon a power-down and power-up sequence of the air handler 102. For example, the fan 106 of the air handler 102 may shut down during a night-time period or when an actual temperature of the building has reached a set-point temperature. To illustrate, in some instances, the first VFD 108 may be in operation while the fan 106 is being utilized. When the air handler 102 discontinues use of the fan 106, the first VFD 108 may correspondingly become inactive or discontinue operation. Upon start-up of the fan 106, the second VFD 110 may initiate operation, while the first VFD 108 remains inactive. In some embodiments, the control circuitry 104 may activate either the first VFD 108 or the second VFD 110 depending on respective total run-times of the VFDs 112 upon power-up of the fan 106. That is, the control circuitry 104 may activate whichever of the VFDs 112 has a lower total run-time.

In some embodiments, the control circuitry 104 may switch operation between the first VFD 108 and the second VFD 110 when the VFD 112 in operation discontinues operation at any point or otherwise becomes unavailable. That is, if one of the VFDs 112 is in operation and discontinues its supply of power to the fan 106 via the motor 120, the other of the VFDs 112 may initiate operation to supply power to the fan 106 via the motor 120. Therefore, if one of the VFDs 112 becomes unavailable, the other VFD 112 may provide power to the fan 106. As used herein, an unavailable VFD 112 may discontinue a supply of power to the fan 106, discontinue communication with the control circuitry 104, supply an unsuitable amount of power to the fan 106, or may otherwise be unavailable. Accordingly, as used herein, such a VFD 112, while configured or adapted to provide power to and control the fan 106, may be referred to as an unavailable VFD 112 or may be referred to as having become unavailable. In some embodiments, the control circuitry 104 may include a sensor 131 configured to detect whether the first VFD 108 and/or the second VFD 110 becomes unavailable. For example, in some embodiments, the sensor 131 may detect a presence and/or an absence of power being provided from the VFDs 112. As a further example, the sensor 131 may detect a presence and/or absence of communication between the VFDs 112 and the control circuitry 104. Indeed, the sensor 131 may be communicatively coupled to the control circuitry 104 and may send data indicative of unavailability of the VFDs 112 to the control circuitry 104.

Particularly, the control circuitry 104 may utilize an alternator 132 and/or a building automation system (BAS) 134 to switch operation between the first VFD 108 and the second VFD 112. The alternator 132 may be integral to the control circuitry 104 and may provide for switching of operation between the VFDs 112. The BAS 134 is a centralized control system of a building, such as the building 10, which may control the building's HVAC system, lighting system, security system, and/or other systems. Particularly, the alternator 132 and/or the BAS 134 may switch operation of the VFDs 112 upon a power-up and power-down sequence, as described herein. Similarly, the alternator 132 and/or the BAS 134 may switch operation of the VFDs 112 when the VFD 112 that is in operation discontinues its supply of power to the motor 120 or is unavailable for any reason. Further, in certain embodiments, the alternator 134 and/or the BAS 134 may switch operation between the first VFD 108 and the second VFD 110 to equalize a run-time between the first VFD 108 and the second VFD 110 or to activate one of the VFDs 112 if it has been inactive for an extended period of time. Indeed, the alternator 132 and/the BAS 134 may function as described herein automatically, such as without user input. In certain embodiments, however, the BAS 134 may switch operation between the first VFD 108 and the second VFD 110 due to manual input/activation from an operator or user. Further, in certain embodiments, the control circuitry 104 may include a manual input device 136, such as a button, knob, user interface, or switch that may switch operation between the first VFD 108 and the second VFD 110 due to manual input/activation from an operator or user.

Figure 6:
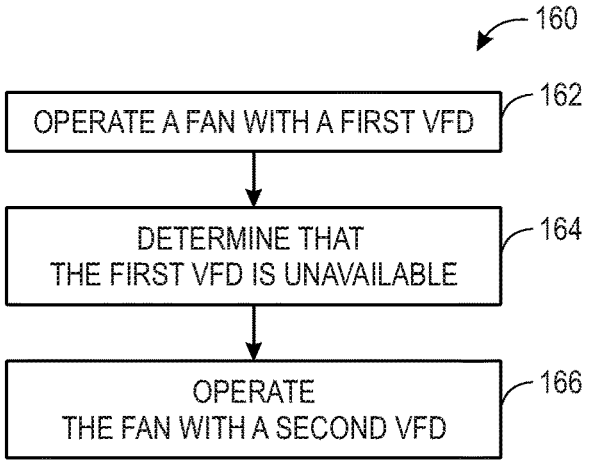
FIG. 6 is a flow diagram for switching operation between a first variable frequency drive (VFD) and a second VFD of an HVAC system, in accordance with an embodiment of the present disclosure.
Figure 7:
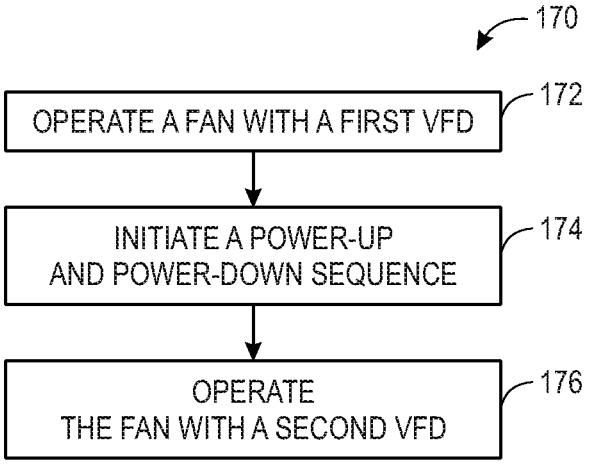
FIG. 7 is a flow diagram for switching operation between a first variable frequency drive (VFD) and a second VFD of an HVAC system, in accordance with an embodiment of the present disclosure.
Figure 8:
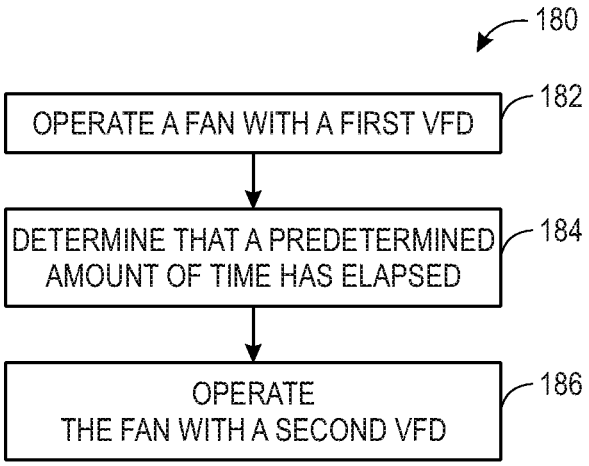
FIG. 8 is a flow diagram for switching operation between a first variable frequency drive (VFD) and a second VFD of an HVAC system, in accordance with an embodiment of the present disclosure.

Keeping this in mind, FIGS. 6-8 are flow diagrams illustrating various methods the HVAC system 103 may utilize to switch operation between the first VFD 108 and the second VFD 110. For example, FIG. 6 illustrates a first method 160 to switch operation between the VFDs 112. At block 162, the control circuitry 104 may provide power to and control the fan 106 via the first VFD 108. At block 164, the control circuitry 104 may determine that the first VFD 108 is unavailable. Indeed, as discussed above, the control circuitry 104 may determine that the first VFD 108 is unavailable when the VFD 108 discontinues a supply of power to the fan 106, discontinues communication with the control circuitry 104, supplies an unsuitable amount of power to the fan 106, or is otherwise be unavailable. Once the control circuitry 104 has determined that the first VFD 108 is unavailable, as discussed with respect to block 164, the control circuitry 104 may instruct the second VFD 110 to operate, or supply power to and control, the fan 106. In certain embodiments, the BAS 134 and/or the alternator 132 may activate the second VFD 110 to switch operation from the first VFD 108 to the second VFD 110.

FIG. 7 illustrates a second method 170 to switch operation between the VFDs 112. At block 172, the control circuitry 104 may provide power to and control the fan 106 via the first VFD 108. At block 174, the HVAC system 103 may undergo a power-up and power-down sequence. For example, the HVAC system 103 may power-down during certain periods of the day, may power-down when an actual temperature of the building has reached the set-point temperature, or may otherwise be powered-down for any other reason such as for maintenance purposes. Upon power-up of the HVAC system 103, the control circuitry 104 may utilize the second VFD 110 to provide power to and control the fan 106, as indicated by block 176. In certain embodiments, the BAS 134 and/or the alternator 132 may activate the second VFD 110 to switch operation from the first VFD 108 to the second VFD 110.

FIG. 8 illustrates a third method 180 to switch operation between the VFDs 112. At block 182, the control circuitry 104 may provide power to and control the fan 106 via the first VFD 108. At block 184, the control circuitry 104 and/or the BAS 134 may determine that a predetermined amount of time has elapsed. In certain embodiments, the predetermined amount of time may refer to a total run-time difference of the VFDs 112. That is, the predetermined amount of time may have elapsed if a total run-time of the first VFD 108 meets or exceeds a predetermined time threshold more than the total run-time of the second VFD 110. As used herein, a total run-time of the VFD 112 may refer to a total amount of time that the VFD 112 is in operation, or supplying power to and controlling the fan 106, over a life of the VFD 112. Further, in certain embodiments, the predetermined amount of time may refer an amount of continuous time that one of the VFDs 112 have been continuously inactive, or not providing power to and controlling the fan 106.

Once it has been determined that the predetermined amount of time has elapsed, as indicated at block 184, the control circuitry 104 may utilize the second VFD 110 to operate, or supply power to and control, the fan 106, as indicated by block 186. In certain embodiments, the BAS 134 and/or the alternator 132 may activate the second VFD 110 to switch operation from the first VFD 108 to the second VFD 110.

Accordingly, the present disclosure is directed to providing systems and methods for redundant variable frequency drives (VFDs). Particularly, an air conditioning unit, such as a rooftop air handler, may include two VFDs to supply power to one or more fans, such as air supply fans, exhaust fans, return air fans, condenser fans, or other fans/blowers. In certain embodiments, one of the VFDs may be in operation at a given point in time. In this manner, if the VFD in operation becomes unavailable, the other VFD be activated to supply power to the fans. Therefore, the air conditioning unit may continue operation instead experiencing downtime due to repairs and/or VFD replacement. Indeed, certain types of buildings, such as hospitals, server rooms, residential housing, power plants, manufacturing buildings, and so forth may benefit from redundant VFDS to continuously supply conditioned air when one of the VFDs becomes inactive.

While only certain features and embodiments of the present disclosure have been illustrated and described, many modifications and changes may occur to those skilled in the art, such as variations in sizes, dimensions, structures, shapes and proportions of the various elements, values of parameters, such as temperatures or pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and air conditioning (HVAC) system, comprising:
- an air moving device configured to move air through the HVAC system;
- a first variable frequency drive (VFD) configured to drive the air moving device;
- a second VFD configured to drive the air moving device, wherein the first VFD and the second VFD are configured receive control instructions and to selectively operate based on the control instructions; and
- control circuitry configured to:
  - drive the air moving device via the first VFD and then receive an indication of a power-down of the HVAC system;
  - after receiving the indication of the power-down of the HVAC system, discontinue drive of the air moving device via the first VFD; and
  - drive the air moving device via the second VFD upon power-up of the HVAC system.

2. The HVAC system of claim 1, wherein the air moving device is a first fan, wherein the HVAC system comprises a second fan, wherein the first VFD is configured to simultaneously drive both the first fan and the second fan, and wherein the second VFD is configured to simultaneously drive both the first fan and the second fan.

3. The HVAC system of claim 1, wherein the control circuitry is configured to provide control instructions that cause the first VFD to drive the air moving device while the second VFD is inactive, wherein the first VFD and the second VFD are configured to drive the air moving device via provision of variable levels of power supply to a motor of the air moving device.

4. The HVAC system of claim 1, wherein the control circuitry is configured to discontinue power supply to the air moving device via the first VFD and supply power to the air moving device via the second VFD upon determining that the second VFD has been inactive for a predetermined time threshold.

5. The HVAC system of claim 1, wherein the control circuitry is configured to:
- drive the air moving device via the first VFD;
- receive a signal from a building automation system (BAS) to drive the air moving device via the second VFD; and
- discontinue drive of the air moving device via the first VFD and drive the air moving device via the second VFD upon receiving the signal from the BAS.

6. The HVAC system of claim 1, wherein the air moving device comprises an air supply fan, an exhaust fan, a return fan, a condenser fan, a blower, or any combination thereof.

7. The HVAC system of claim 1, wherein the control circuitry is configured to:
- drive the air moving device via the first VFD; and
- drive the air moving device via the second VFD once the first VFD becomes unavailable to provide power to the air moving device.

8. A heating, ventilation, and air conditioning (HVAC) system, comprising:
- a first air moving device configured to move air through the HVAC system;
- a second air moving device configured to move air through the HVAC system;

a first variable frequency drive (VFD) configured to variably supply power to the first air moving device and the second air moving device based on control instructions;

a second VFD configured to variably supply power to the first air moving device and the second air moving device based on the control instructions; and control circuitry configured to:

supply power to the first air moving device and the second air moving device via the first VFD and then receive an indication of a power-down of the HVAC system;

after receiving the indication of the power-down of the HVAC system, discontinue supply of power to the first air moving device and the second air moving device via the first VFD; and supply power to the first air moving device and the second air moving device via the second VFD upon power-up of the HVAC system.

9. The HVAC system of claim 8, comprising a rooftop unit, wherein the rooftop unit comprises the first air moving device, the second air moving device, the first VFD, and the second VFD.

10. The HVAC system of claim 8, wherein the control circuitry comprises an alternator configured to discontinue supply of power to the first air moving device and the second air moving device via the first VFD and initiate supply of power to the first air moving device and the second air moving device via the second VFD.

11. The HVAC system of claim 8, wherein the control circuitry comprises an alternator configured to discontinue supply of power to the first air moving device and the second air moving device via the first VFD and initiate supply of power to the first air moving device and the second air moving device via the second VFD upon a determination that the second VFD reaches a threshold time for inactivity.

12. The HVAC system of claim 8, wherein the control circuitry comprises an alternator configured to discontinue supply of power to the first air moving device and the second air moving device via the first VFD and initiate supply of power to the first air moving device and the second air moving device via the second VFD upon a determination that the first VFD is unavailable.

13. The HVAC system of claim 8, wherein the control circuitry comprises an alternator configured to discontinue supply of power to the first air moving device and the second air moving device via the first VFD and initiate supply of power to the first air moving device and the second air moving device via the second VFD upon a determination that a difference between a first total run-time of the first VFD and a second total run-time of the second VFD reaches a predetermined time difference threshold.

14. The HVAC system of claim 8, comprising a wherein the control circuitry is configured to discontinue supply of power to the first air moving device and the second air moving device via the first VFD and initiate supply of power to the first air moving device and the second air moving device via the second VFD upon receiving a signal from a building automation system.

15. The HVAC system of claim 8, wherein the first VFD and the second VFD are configured to supply power to the first air moving device via a first motor, and wherein the first VFD and the second VFD are configured to supply power to the second air moving device via a second motor.

16. A heating, ventilating, and air conditioning (HVAC) system, comprising:

a fan configured to drive air through the HVAC system;

a first variable frequency drive (VFD) configured to provide power to the fan;

a second VFD configured to provide power to the fan; and a controller configured to control the first VFD and the second VFD to alternatingly provide power to the fan, wherein the controller is further configured to:

drive the fan via the first VFD and then receive an indication of a power-down of the HVAC system;

after receiving the indication of the power-down of the HVAC system, discontinue drive of the fan via the first VFD; and drive the fan via the second VFD upon power-up of the HVAC system.

17. The HVAC system of claim 16, wherein the controller is configured to:

detect that the first VFD is unavailable; and provide power to the fan utilizing the second VFD upon detection that the first VFD is unavailable.

18. The HVAC system of claim 16, wherein the controller comprises an alternator configured to:

upon start-up of the HVAC system, activate either the first VFD or the second VFD to power the fan based on respective total run-times of the first VFD and the second VFD.

19. The HVAC system of claim 16, comprising a manual input device configured to switch between operation of the first VFD and operation of the second VFD upon manual activation of the manual input device.

20. The HVAC system of claim 16, wherein the fan comprises a first air supply fan and a second air supply fan, each configured to supply conditioned air to a building, and wherein the controller is configured to control the first VFD and the second VFD to alternatingly provide power to both the first air supply fan and the second air supply fan.

21. The HVAC system of claim 16, comprising an alternator and a building automation system, wherein the controller is configured to switch from powering the fan utilizing the first VFD to powering the fan with the second VFD based on input from the alternator or the building automation system.

* * * * *